United States Patent [19]

Castiglioni

[11] Patent Number: 4,867,494

[45] Date of Patent: Sep. 19, 1989

[54] ARTICULATED COVER-HOLDER TO BE MOUNTED ON SMALL SUITCASES

[76] Inventor: Claudio Castiglioni, Via Coni Zugna, 10, 21100 - Varese, Italy

[21] Appl. No.: 441,800

[22] Filed: Nov. 15, 1982

[30] Foreign Application Priority Data

Apr. 19, 1982 [IT] Italy ..... 21604/82[U]

[51] Int. Cl.[4] ..... F05C 17/32

[52] U.S. Cl. ..... 292/263; 292/338; 16/342; 217/60 R; 217/60 E; 403/96; 411/546

[58] Field of Search ..... 292/262, 263, 103, 204, 292/338; 217/60 R, 60 E; 403/94, 96, 97, 92; 411/535, 536, 544, 546; 16/319, 337, 341, 342, 344

[56] References Cited

U.S. PATENT DOCUMENTS 1,311,473 7/1919 Vossler ..... 411/546
2,442,955 6/1948 Lundberg ..... 292/263 X
3,119,591 1/1964 Malecki ..... 403/96 X
3,412,420 11/1968 Seckerson ..... 403/96 X
3,433,511 3/1969 Frankel ..... 403/96
3,997,222 12/1976 Horak ..... 292/263 X
4,238,165 12/1980 Wagner ..... 411/546 X

FOREIGN PATENT DOCUMENTS 286439 3/1928 United Kingdom ..... 217/60 E

*Primary Examiner*—Gary L. Smith
*Assistant Examiner*—Eric K. Nicholson
*Attorney, Agent, or Firm*—Michael J. Striker

[57] ABSTRACT

A holder for connecting a cover of a suitcase to its bottom is formed of two pivotable arms connected to each other by a joint which includes a washer of plastic material interposed between two arms to reduce friction therebetween and a pin extending through the arms and the washer to hold them in assembly.

5 Claims, 2 Drawing Sheets

ARTICULATED COVER-HOLDER TO BE MOUNTED ON SMALL SUITCASES

BACKGROUND OF THE INVENTION

The present invention relates to a device composed of two arms, flattened in shape, which are joint-articulated with each other and have the free extremities pivoted on the respective lateral walls of the bottom and of the cover of an ordinary suitcase, in order to keep the cover itself lifted in respect to the bottom, when the suitcase is in open position.

Devices of this type, which from now on will be simply called cover-holders, are already known, but they are either of limited practical use or composed of a high number of components which require particular machining and are difficult to mechanically assemble.

To the first category belong, for instance, the cover-holders having two arms, generally coplanar, provided with an articulated joint rather simple and permitting a right angle opening between the cover and the bottom of the suitcase.

In these types of cover-holders, the opening and the subsequent holding in position of the cover is obtained when two said arms, rotating around the central joint, reach a perfect alignment, blocking themselves in this position, this determining a sort of strut between the bottom and the cover of the suitcase.

The most important disadvantage of said technique is the need to release manually the two arms of each cover-holder before proceeding the suitcase shutting.

Should the user forget to accomplish this operation, the force exerted on the cover could lead to the breakage of the joints between the arms and the lateral walls of the suitcase, or to the breakage of the articulation connection between the arms themselves, or directly of the articulation joints between the cover and the bottom of the suitcase. Cover-holders are also known which, once in place, do not require any manual operation, but, as already said, they are very complicated from a constructional point of view and do not lend themselves to be assembled.

For instance, according to another well-known technique, in the articulation joint of the two cover-holder arms, properly hinged between them, is placed a spring, laying at one extremity on a small sphere suitable to engage in a proper seat machined in one of the two arms, which blocks the cover-holder and keeps it in a lifted position.

SUMMARY OF THE INVENTION

The cover-holder of the present invention is composed of a reduced number of components which do not require any particular machining and can be easily assembled mechanically.

It is composed of two arms having a plane shape and whose width is diminishing from one extremity to the other, in order to present through-holes at the corresponding reduced extremities, where the lateral walls of the suitcase bottom and cover are pivoted.

The enlarged extremities of said two arms terminate with a semicircular connector and are articulated by a joint.

A characteristic of the present invention is the simplicity of said joint, which, by means of a washer, preferably of plastic material, interposed between the extremities of said arms (partially superimposed one to the other), act as an antifriction device between the arms themselves, which are preferably metallic, as a release spring for said arms and, finally, as a lock to keep the cover lifted relative to the bottom when the suitcase is open.

Said washer, circular in shape and having a radius equal to the one of said extreme arm connectors, is provided on one face with two small stakes, placed in diametrically opposite positions, fit to engage into proper holes formed in one of the two arms in order to block the washer with respect to the arm itself.

On the same face of the washer and laterally to the line joining said stakes, some millings are provided in order to decrease the thickness of the washer itself in those areas.

On the other face of the washer, in correspondence to said millings, two juts exist, in diametrically opposite positions, fit to interfere with corresponding juts existing on the other arm of the cover-holder, in order to provide for the locking of the cover itself.

The assembly of the two arms and the joint washer is provided by means of a pin passing through aligned holes existing in these three elements.

Said pin is simply riveted on the stem side.

Further characteristics of the present invention will result clearer after the following description which refers to an example of embodiment illustrated in the enclosed drawings.

BRIEF DESCRIPTION OF THE PREFERRED EMBODIMENTS

DETAILED DESCRIPTION OF THE PREFERRED EMBODIMENTS

Figure 1:
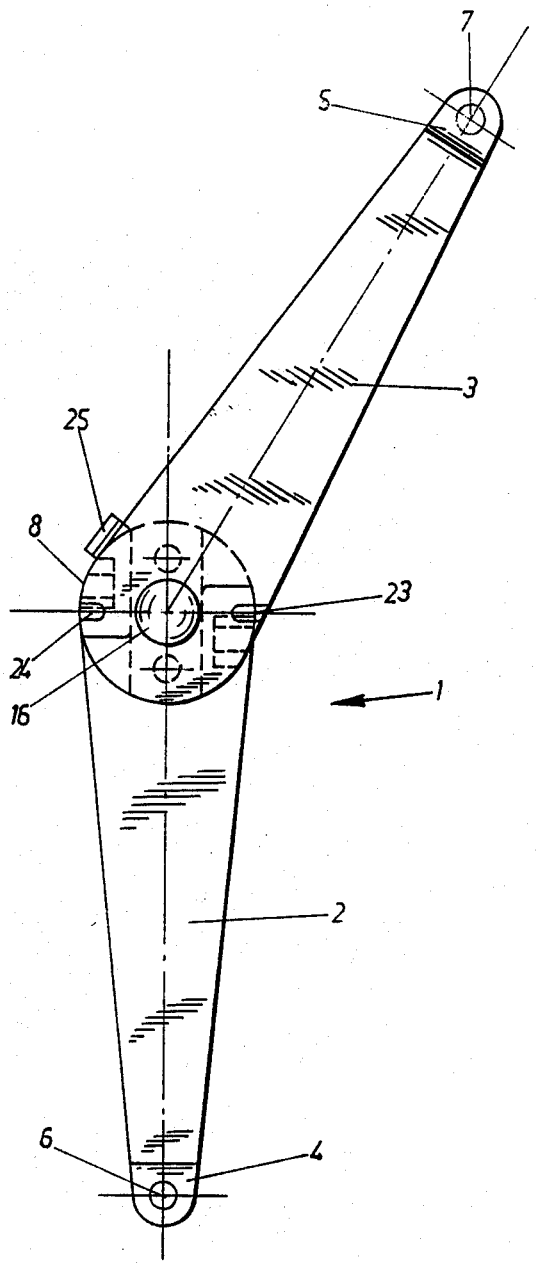
FIG. 1 is a plan view of the cover-holder according to the present invention.
Figure 2:
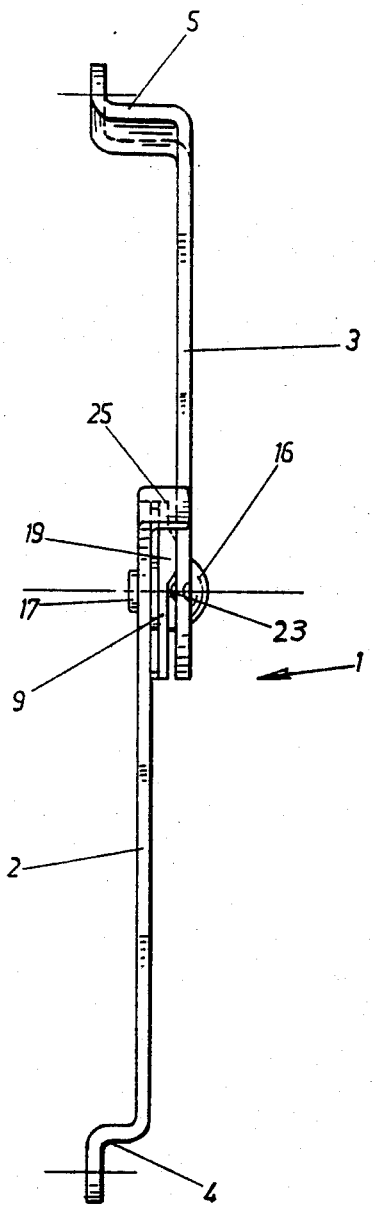
FIG. 2 is a side view of the cover-holder of FIG. 1.

Referring in particular to FIGS. 1 and 2 the cover-holder of the present invention is indicated as a whole by a reference character 1.

As it may be noted from said figures, the holder is composed of two arms 2 and 3 preferably metallic, having an almost identical shape. Said arms 2 and 3 each have an extension mainly planar, decreasing in width from one extremity to the other.

At their, narrow extremities, they have S-shaped laps 4 and 5, respectively, provided with through-holes 6 and 7 for the pivoting to the respective lateral bottom and cover suitcase walls.

Arms 2 and 3 are mutually articulated by means of a joint 8 provided at the other extremities, properly rounded, of the arms.

In joint 8, interposed between the two arms 2 and 3, is placed a washer 9, preferably of plastic material, provided to prevent, among other things, friction between the two arms when they slide one over the other during the opening and shutting of the suitcase.

Figure 4:
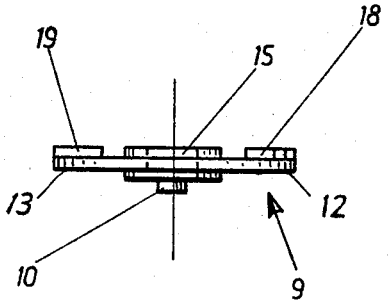
FIG. 4 is a side view of the washer of FIG. 3.

Washer 9 (see FIGS. 3 and 4) provided with a central hole 14 carries on one of its faces two small stakes 10 and 11, diametrically positioned, only one of which is visible in the side view of FIG. 4, the other being covered by the first.

Figure 3:
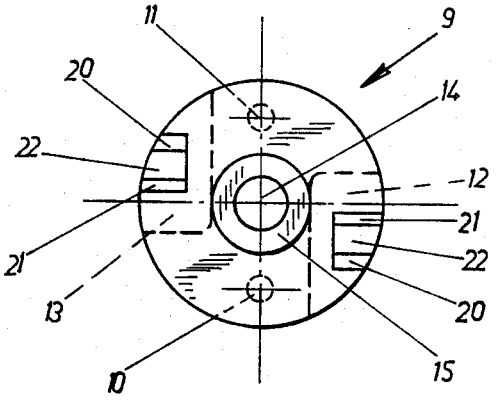
FIG. 3 is a plan view of the washer interposed between the two arms in correspondence to their articulated joint.
Figure 5:
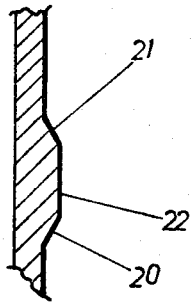
FIG. 5 is, in enlarged scale, a section taken on line V—V of FIG. 3.

In the plan view of FIG. 3, on the contrary, the traces of said small stakes are both visible.

The stakes 10,11 engage the respective holes 30 formed in one of two cover-holder arms (in the example shown, in arm 2) in order to block the washer itself to said arm.

On the same face of washer 9, carrying stakes 10 and 11, and laterally of them and symetrically to the washer center, are machined two plane millings 12 and 13 respectively, formed to decrease the washer thickness in these areas, for reasons that will be explained later.

In FIG. 3 the traces of said millings are visible.

On the other face of washer 9, around said hole 14, an annular jut 15 is provided, formed to keep properly spaced the two cover-holder arms when the whole is assembled.

Said assembly is done by means of a pin 16 having an ovoidal head, and a stem 17, passing through the related holes existing in the two cover-holder arms, in alignment with washer hole 14, stem 17 being simply riveted at its free extremity.

On the same face of washer 9, provided with said annular jut 15, two other juts 18 and 19 exist having a trapezoidal cross section; they are placed in diametrally opposed positions, in correspondence with millings 12 and 13 machined on the opposite face.

These two juts 18, 19 are provided, respectively with inclined surfaces 20 and 21 converging toward a superior plane surface 22, parallel to the washer face and placed at the same level of the annular jut 15 (see FIG. 4).

Arm 3 of the cover-holder 1, is provided on its face turned to washer 9, in correspondence with articulated joint 8, with two further juts 23 and 24 fit to cooperate respectively with juts 18 and 19 carried by the washer 9, in order to establish the holding position of the cover-holder.

With particular reference to FIG. 1, it is now illustrated the operation of the cover-holder described in the present application.

Supposing the two arms in shutting position, that is partially superimposed one to the other, if we separate them by opening the suitcase, a rotation of said arms in a counter direction is generated in the articulated joint 8.

More precisely, in the situation illustrated in FIG. 1, arm 3 will rotate in the counterclockwise direction and arm 2 in the clockwise direction solidly with washer 9.

During such rotation, juts 23 and 24 of arm 3 will initially interfere with inclined surfaces 20 of the respective juts 18 and 19 of washer 9, incurring in a gradually increasing resistance up to the top of said surfaces.

Then juts 23, 24 will place themselves on the plane area 22 and finally will redescend from inclined surfaces 21, reaching the position indicated in FIG. 1.

It should be noted that in this phase the juts of washer 9 act as a release spring of the articulated joint 8, bending themselves when the respective juts of arms 3 of the cover-holder are passing.

Said bending is made possible by the millings existing on the washer opposite face in correspondence with said juts.

In the position of FIG. 1, the juts of washer 9 interfering with the respective juts of arm 3 act as a holder, preventing the shutting of the cover-holder and keeping the suitcase cover lifted relative to the suitcase bottom.

It is to be noted that the maximum opening of the cover-holder is established by a jut 25 formed on arm 2, in its rounded extremity in correspondence with joint 8 and extended perpendicularly to the plane portion of said arm and directed towards arm 3.

Said jut 25 is fit to interfere with this arm 3 in order to prevent a further rotation of the same.

Logically, said jut 25 may be placed in positions different from those indicated in FIGS. 1 and 2, thus permitting different maximum opening angles of the cover-holder.

In the position of FIG. 1, to disengage the two cover-holder arms and to shut the suitcase, it is not necessary to operate manually on the cover holder: it is sufficient to lower the suitcase cover.

Juts 23,24 of arm 3, overcoming the respective juts of washer 9, permit rotations of said arms exactly contrary to those previously described.

Of course the invention is not limited to the embodiment form described, being possible to include many detail modifications, still remaining within the scope of the invention itself.

I claim:

1. A holder for connecting a cover to a respective wall of a suitcase, comprising two arms connected to each other by a joint such that said arms are mutually articulated, said arms having free ends respectively pivotable relative to said wall and said cover to position said cover in its lifted position or its closed position with respect to a remaining portion of the suitcase; said arms each having at said joint a central hole, one of said arms being formed with two diametrally opposing openings spaced from the central hole of said one arm; a washer made of plastic material and interposed between said two arms and formed with a central hole aligned with the central holes of said arms; a pin passing through the central holes of said arms and said washer and being rigidly secured to one of said arms, said washer being provided at a face thereof facing said one arm with two diametrally opposing projections respectively engaged in said two openings of said one arm, the other of said arms being formed with two ribs, said washer being formed on a face facing said other arm with two lateral juts, on said washer having a trapezoidal cross-section, said ribs on said other arm cooperating with said juts so as to slide over said juts during the pivoting of said arms and to act against said juts to hold the cover in its lifted position.

2. The holder as defined in claim 1, wherein said pin is riveted to said one arm.

3. The holder as defined in claim 1, wherein said washer is provided with two millings formed at its face facing said one arm and in the regions corresponding to those in which said juts are formed at an opposite face of the washer, said millings allowing bending of the washer during the pivoting of said arms.

4. The holder as defined in claim 3, wherein said one arm is provided with a projection extended outwardly of said arm towards said other arm and adapted to limit an opening angle of the holder.

5. The holder as defined in claim 4, wherein said washer has a central jut at the face of the washer facing said other arm.

* * * * *